United States Patent [19]

Reichen et al.

[11] 4,166,200

[45] Aug. 28, 1979

[54] COMPACT ROTARY SWITCH CONSTRUCTION

[75] Inventors: John E. Reichen, Portland; Scott B. Long, Beaverton, both of Oreg.

[73] Assignee: Tektronix, Inc., Beaverton, Oreg.

[21] Appl. No.: 931,337

[22] Filed: Aug. 7, 1978

Related U.S. Application Data

[63] Continuation of Ser. No. 603,420, Aug. 11, 1975, abandoned.

[51] Int. Cl.[2] ..... H01H 3/00; H01H 19/00

[52] U.S. Cl. ..... 200/11 R; 200/11 G; 200/14; 200/17 R; 200/18

[58] Field of Search ..... 200/11 R, 11 D, 11 DA, 200/11 G, 11 J, 11 K, 11 TW, 14, 17 R, 18

[56] References Cited

U.S. PATENT DOCUMENTS

| | | | |
|---|---|---|---|
| 2,576,836 | 11/1951 | Hilsinger, Jr. | 200/14 X |
| 2,811,594 | 10/1957 | Papouschek | 200/14 |
| 3,031,541 | 4/1962 | Hoffman | 200/14 X |
| 3,207,861 | 9/1965 | White | 200/14 |
| 3,571,534 | 3/1971 | Ashman | 200/14 X |
| 3,584,163 | 6/1971 | White | 200/11 G |
| 3,736,390 | 5/1973 | Lockard | 200/11 G X |
| 3,746,804 | 7/1973 | Gammill | 200/14 |
| 3,754,106 | 8/1973 | MacDonald | 200/11 DA X |
| 3,761,649 | 9/1973 | Jedynak et al. | 200/14 |
| 4,131,771 | 12/1978 | Erickson et al. | 200/11 DA |

FOREIGN PATENT DOCUMENTS

| | | | |
|---|---|---|---|
| 699638 | 12/1964 | Canada | 200/14 |

*Primary Examiner*—James R. Scott
*Attorney, Agent, or Firm*—John D. Winkelman

[57] ABSTRACT

An improved shaft-operated rotary switch construction for printed circuitry applications is disclosed. The improved switch is a modular design incorporating a standardized rotor element accommodating the mounting of wiper contacts in different positions and different operational orientations. Also disclosed is an improved releasable clutch mechanism providing one mode of operation in which the rotors of different switch sections are coupled together for simultaneous rotation, and another mode in which they are rotatable independently, the operating mode being selected by axial movement of one section's operating shaft relative to that of the other.

10 Claims, 11 Drawing Figures

COMPACT ROTARY SWITCH CONSTRUCTION

This is a continuation of application Ser. No. 603,420, filed Aug. 11, 1975 now abandoned.

BACKGROUND AND OBJECTS OF THE INVENTION

The present invention relates generally to electrical switching apparatus, and more particularly to an improved multiposition rotary switch for interconnecting different electrical contact pads on an insulating substrate such as a printed circuit board.

Modern electronic equipment makes substantial use of so-called "printed" circuitry, and it is often necessary or desirable to perform multiple switching operations directly on the board or other substrate bearing the circuitry. A number of different multiposition rotary switch constructions have been proposed for such use. Certain constructions, such as those disclosed in U.S. Pat. Nos. 3,031,541 to Hoffmann and 3,531,603 to Ashman, include a rotor having bridging contact means for interconnecting fixed contact pads arranged in concentric rings on a printed circuit board. The contact means bridge corresponding pads in the different rings at appropriate angular positions of the rotor.

While satisfactory in many applications, such prior art designs have a number of drawbacks. For example, rotor contacts of the type shown in Ashman are relatively bulky, making them unsuited for use in miniature switches, particularly in applications requiring a large number, e.g., 20 or more, switch positions. Moreover, the use of a separate coil spring in each contact assembly to produce the necessary contact force increases both the cost and the complexity of the switch. The integral detent cam/contact carrier construction of Hoffmann limits design flexibility and greatly increases the overall size of multirotor-type switches.

Accordingly, one object of the present invention is to provide an improved multiposition rotary switch adapted for circuit board use which is without the drawbacks of known prior art designs.

Another object of the invention is to provide an extremely compact multiposition rotary switch which can be manufactured economically in large quantity.

Yet another object of the invention is to provide an improved rotary switch construction employing modular elements which can be assembled in different combinations for different applications.

Still another object of the invention is to provide an improved rotatable bridging contact-type printed circuit switch having a rotor adapted for mounting multifinger wipers in different operational orientations.

Some electronic instruments, some cathode ray oscilloscopes for example, require a multiple section rotary switch having plural operating modes, including one mode in which the rotors of the different sections are coupled together for simultaneous rotation, and another mode in which they are independently rotatable. Certain of these instruments require a switch of the type just described in which the independent rotation mode is selectable only at certain switch positions, or in which a given section's rotors are independently rotatable only within a range of switch postions determined by the position of another section's rotors.

In prior art printed circuit rotary switches, coupling and decoupling of different switch sections is accomplished by means in the switches' operating knobs.

Knobs including releasable coupling mechanisms are necessarily much larger than desirable in many applications, particularly those where instrument panel space is limited. Thus there is a need for a compact releasable coupler able to perform the above-described functions, and capable of being integrated into a miniature printed circuit rotary switch.

Accordingly, a further general object of the invention is to provide an improved releasable coupler mechanism constructed to meet the just-described needs in a practical and satisfactory manner.

A related object is to provide an improved multiple section, shaft operated rotary switch having integrated means releasably coupling the sections together for conjoint operation, and having operating shaft-actuated means for decoupling the sections to enable independent operation.

A more specific object of the invention is to provide a compact, integrated, inter-section coupler for a multiple section, shaft-operated rotary switch, the coupler being releasable upon axial movement of one section's operating shaft to enable independent operation of that section.

Still a further object of the invention is to provide such a coupler having means preventing its release in certain switch positions.

Yet a further object of the invention is to provide a coupler of the type described in which the switch position setting of one section determines the range of positions within which another section can be operated independently.

These and other objects, features and advantages of the present invention will be apparent to those skilled in the art as the following detailed description of certain preferred embodiments is read in conjunction with the accompanying drawings.

DESCRIPTION OF PREFERRED EMBODIMENTS

Figures 1, 2, 11:
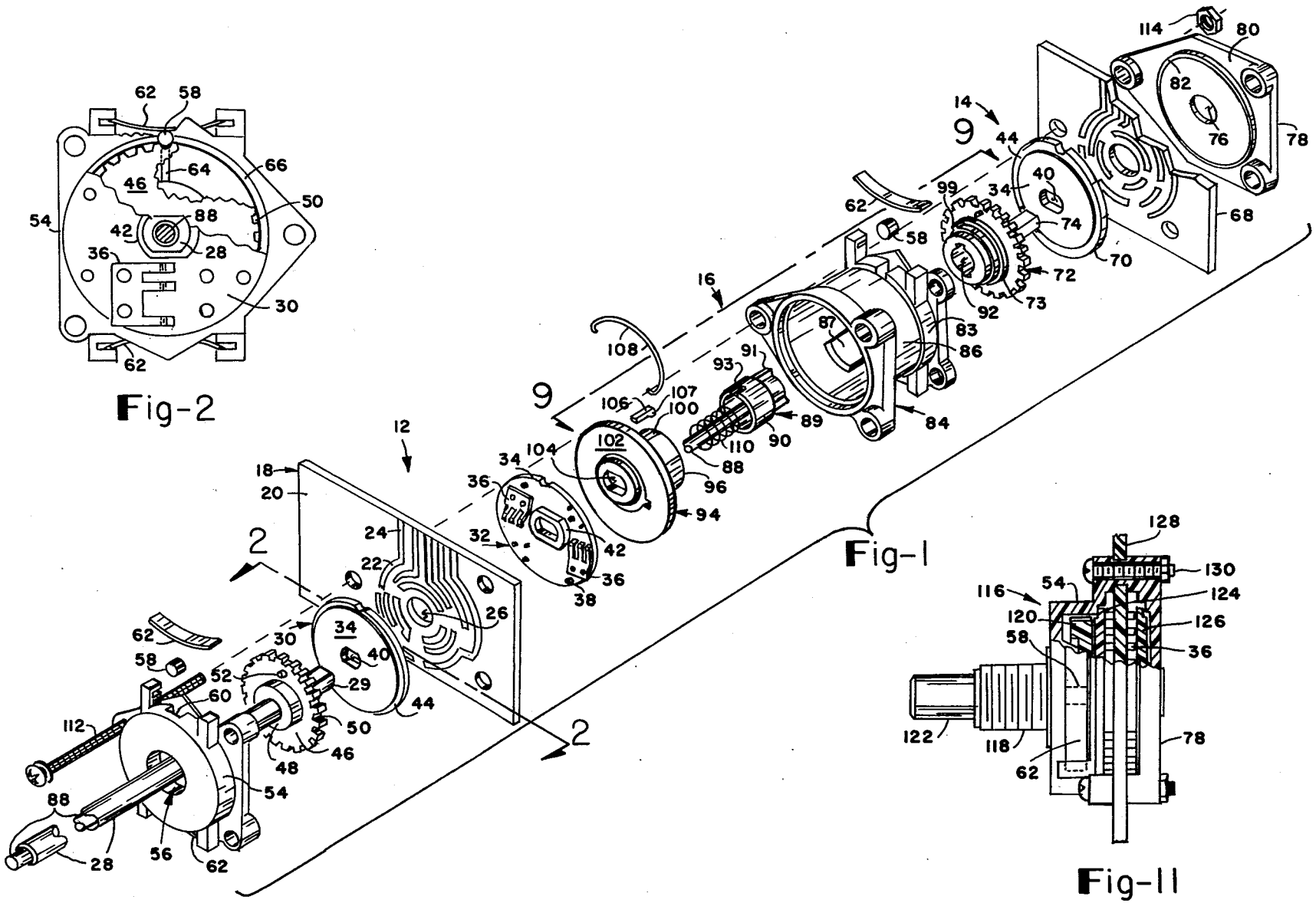
FIG. 1 is an exploded perspective view showing one embodiment of the invention—a dual section printed circuit board rotary switch incorporating an integrated releasable coupler between the sections.
FIG. 2 is an enlarged rear elevation view, taken looking forward from line 2—2 of FIG. 1 and showing a portion of one switch section in an assembled condition.
FIG. 11 is a top plan view, partly in section, of another embodiment of the invention—a single section panel mount rotary switch.

Turning now to the drawings wherein like reference numerals indicate like elements throughout, one embodiment of the invention—a dual section rotary switch—is indicated generally at 10 in FIG. 1. Switch 10 includes a front section 12 and a rear section 14 releasably coupled by a clutch assembly 16. Front section 12 comprises a stator 18 in the form of a conventional printed circuit board 20. Board 20 is provided with a pattern of electrical contact pads 22 and runs 24 on both its front and rear surfaces. The pads on each surface are arranged in multiple concentric rings about an opening 26 in the board, the rings on one surface thus being coaxial with those on the other surface. As will be appreciated, the number of rings on each surface and the number and configuration of the contact pads within each ring will vary depending upon the switching requirements of the particular application.

Extending through opening 26 in stator 18 and rotatable therein is an elongate tubular shaft 28 having a double-flatted end portion 29. Received and supported on shaft portion 29 for rotation with shaft 28 are a pair of rotors 30,32 disposed in face-opposed relation to the front and rear surfaces, respectively, of stator 18. Rotors 30,32 are similar in construction, each consisting of a disklike body 34 molded of a suitable dielectric, such as an electrical grade plastic, and one or more multifinger wipers 36. Wipers 36 are secured in position on bodies 34 on pairs of integral mounting studs 38. The mounting studs, which herein are cylindrical projections, are disposed in four equally spaced-apart groups of three on one face of each rotor body, as shown in FIGS. 1–5. The studs in each group are at locations corresponding to the corners of an isosceles right triangle. This permits mounting of a wiper 36 in either of two different operational orientations, as will be explained more fully later on.

Still referring to FIGS. 1–5, each wiper 36 is a flat metallic spring member having two or more spaced fingers bent as shown in FIG. 1 to provide multiple independent spring contacts. For economy of manufacture, wipers 36 are formed with the maximum desired number of contact fingers, herein four as at 36*a* in FIG. 5. Other wiper configurations, such as those shown at 36*b*, 36*c*, . . . 36*h* in FIGS. 2–5, are provided by removing certain of the fingers. Each wiper 36 has two mounting holes sized and spaced to provide a snug fit on an appropriate pair of the mounting studs 38. After mounting, the wipers are anchored in place by deforming the studs.

Further describing the construction of rotors 30,32, each body 34 includes a central opening 40 configured to accomodate end portion 29 of shaft 28. An integral boss 42 is provided on the wiper-bearing face of body 34 surrounding opening 40, and an integral flange 44 extends about the periphery of the rotor body. The functions of boss 42 and flange 44 will be explained shortly.

Front section 12 additionally includes a multiposition detent cam 46 having an integral neck portion 48. The cam includes a plurality of uniformly spaced peripheral notches 50, the number being determined by the number of switching positions required. Up to about 32 positions can be provided using a ¾" diameter cam. An integral rotation stop 52 is provided on the front face of cam 46, it being understood that the stop may be omitted if continuous rotation is desired. Detent cam 46 is secured to shaft 28 in any suitable manner, such as by molding it on the shaft.

Referring now to FIG. 2 along with FIG. 1, cam 46 is received in front housing 54 of the switch with neck 48 fitted in a central tubular passage 56 in the housing. A pair of rollers 58, each loosely captured in a corresponding opening 60 in the housing, are forced against the periphery of cam 46 by flat springs 62 to index rotors 30,32 at different discrete rotational positions determined by the number and spacing of notches 50. An internal rib 64 (FIG. 2) is provided in housing 54 for engaging stop 52 on detent cam 46. Front rotor 30 is positioned with its flange 44 seated against a recessed annular bearing surface 66 (FIG. 2) at the rear of the housing. Boss 42 of rotor 30 contacts the front on circuit board 20 in the region surrounding opening 26. The height of the boss thus determines the spacing of the rotor from the board, which necessarily is greater than the height of the mounting studs 38.

Referring again to FIG. 1, the rear section 14 of switch 10 includes a printed circuit board stator 68, a rotor 70, and a detent cam 72. Stator 68 and rotor 70 are similar in all essential respects to stator 18 and rotor 30, respectively, of front section 12, except that stator 68 has contact pads on its front surface only. Detent cam 72 includes a stepped neck portion 73 and an integral, double-flatted stub shaft 74 on which rotor 70 is received and supported for rotation. The stub shaft extends through and is rotatable in the central opening in stator 68. The end of the shaft is received and supported in an opening 76 in rear bearing plate 78. It should be noted that bearing plate 78 has a raised annular bearing surface 82 on its front face 80 for seating a rotor flange 44 in switch embodiments (such as the one shown if FIG. 11) which include a rotor positioned between the rear bearing plate and the rear surface of a stator.

Detent cam 72 is received in the rear end portion 83 of a transition member 84. Portion 83 is essentially similar in configuration to front housing 54, and thus includes a pair of rollers 58 forced by springs 62 against the periphery of cam 72. As will be appreciated, the number and spacing of the notches on cam 72 is the same as on cam 46. In a manner identical to that described earlier in connection with rotor 30, rotor 70 is positioned with its flange seated against a recessed bearing surface 85 (FIGS. 9 and 10) in end portion 83 of the transition member. Member 84 further includes a hollow, generally cylindrical body portion 86. A curved projection 87 is joined to the inner wall of portion 86 for a purpose to be described.

Rotation of detent cam 72 and rotor 70 is enabled by means of an elongate shaft 88 extending coaxially through shaft 28. Joined to the rear end of shaft 88 is a coupling part 89 having a cylindrical portion 90 and a reduced diameter, keyed portion 91. Portion 91 is received within a complementary-shaped cavity 92 in stepped neck portion 73 of cam 72. For reasons which will become apparent, keyed portion 91 is sized for free axial movement in cavity 92. Cylindrical portion 90 includes a single longitudinally-extending keyway 93, the function of which will be explained shortly.

Figure 9:
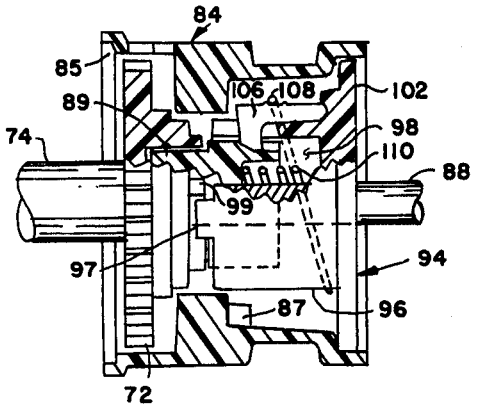
FIG. 9 is a side elevation view, partly broken away and partly in section, taken looking to the right from line 9—9 in FIG. 1 and showing a releasable inter-section coupler in a coupled condition.
Figure 10:
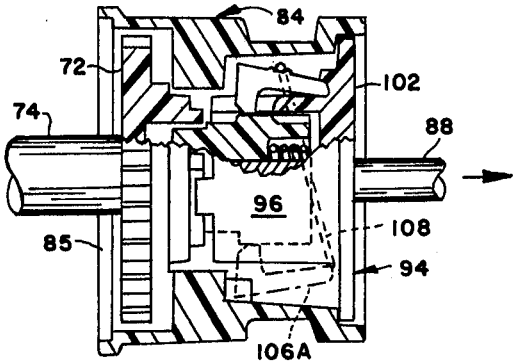
FIG. 10 is a similar view of the coupler in a decoupled condition.

Referring now to FIGS. 9 and 10 along with FIG. 1, clutch assembly 16 includes an outer part 94 coupled to front section 12 and an inner part—previously described part 89—coupled to rear section 14. Parts 94 and 89 are housed in transition member 84. Outer clutch part 94 comprises an open-ended tubular portion 96 having an axially-extending cylindrical chamber 98 therein. A slot 100 in portion 96 opens into the chamber. Integral with the forward end of portion 96 is a disklike end plate 102 having a central opening 104. Opening 104 is essentially identical in configuration to rotor body opening 40, and receives the end of shaft portion 29 for rotation of outer clutch part 94 upon rotation of shaft 28.

Seated against end plate 102 and extending rearward along tubular portion 96 is a generally L-shaped key 106 having a beveled toe 107. Key 106 is retained in position on portion 96 with its toe in slot 100 by a C-shaped wire spring 108.

Referring now particularly to FIGS. 9 and 10, outer clutch part 94 is received in body portion 86 of the transition member with the outer rim of end plate 102 seated against the recessed annular bearing surface at the forward end of the member. Inner clutch part 89 is also disposed in body portion 86 of member 84, with the cylindrical portion of part 89 nested in chamber 98. A compression spring 110 provided on shaft 88 is captured between the inner and outer clutch parts.

Again referring to FIG. 1, switch 10 is secured together using three machine screws 112 and nuts 114 (one of each shown) extending through the mounting ears provided on front housing 54, transition member 84 and rear bearing plate 80, and the corresponding mounting holes in stators 18 and 68.

As should by now be apparent, the various switch positions of section 12 are selected by rotating shaft 28 in the appropriate direction, rotation in either direction being limited by engagement of stop 52 with rib 64. Likewise, section 14 is operated by means of shaft 88, rotation being limited in the same manner, and at the same position, by a stop on cam 72 and a rib in transition member end portion 83.

With the rotors of sections 12 and 14 indexed at the same position, clutch assembly 16 acts to couple the two sections for conjoint rotation by releasably coupling their respective operating shafts 28,88. Referring to FIG. 9, for example, coil spring 110 biases inner clutch part 89 toward the left in the figure to the position shown, outer part 94 not being free to move axially. Key 106 then engages keyway 93 to lock the outer and inner clutch parts together for rotation as a unit.

Now referring to FIG. 10, the clutch is disengaged by pulling shaft 88 forward (to the right in the figure), moving inner part 89 farther into chamber 98. This causes key 106 to swing outward as axial pressure is applied against its toe 107 by the beveled rear end (i.e., left end) of keyway 93, coming to rest on the smooth outer surface of the inner clutch part's cylindrical portion 90. Thus, with shaft 88 pulled forward, the two sections are disengaged and are rotatable independently by rotation of their respective shafts.

Projection 87 on the inner wall of transition member body portion 86 prevents disengagement of the clutch at certain switch positions by preventing key 106 from swinging out far enough to clear keyway 93, i.e., to the position indicated in phantom outline at 106A. To suit the particular application, projection may be angularly repositioned, or made longer or shorter. If it is desired to permit disengagement at any switch position, which normally is the case, projection 87 is omitted entirely.

"Misrotation" of the two switch sections is prevented by engagement of ear 97 on the outer clutch part's tubular portion 96 with projection 99 on the stepped neck portion of detent cam 72. By way of explanation, the limit of independent rotation in a counterclockwise direction (as viewed in FIG. 1) of rear switch section rotor 70 is determined by the position of the front switch section's rotors 30,32. And because neither outer clutch member 94 nor detent cam 72 is free to move axially in the switch, the just-mentioned limit is not affected by the condition of the clutch, i.e., whether it is engaged or disengaged. The result is that switch section 14 cannot be misrotated to a switch position which is farther counterclockwise than section 12. This special feature, useful in certain applications, may be eliminated if desired by omitting ear 97 or projection 99.

The basic components or modules of the switch described above may be assembled in a manner of different ways to suit different applications. For example a second embodiment of the invention in the form of a single section, two rotor panel mount circuit board switch 116 is illustrated in FIG. 11. Switch 116 includes a front housing 54 provided with a threaded bearing insert 118 and containing a detent cam 120. Detent cam 120 is similar to cam 46 but lacks neck 48. The cam is fixed on a solid shaft 122 supporting rotors 124 and 126 on the opposite sides of circuit board stator 128 for rotation relative to the stator. Rotors 124, 126 and stator 128 are substantially identical to corresponding elements 30, 32 and 18 of switch 10. A bearing plate 78 supports the rear (i.e., left) end of shaft 122. Front housing 54 and bearing plate 78 are secured to stator 128 with threaded fasteners 130 in a conventional manner.

Figure 3:
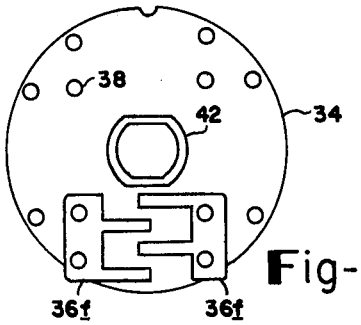
FIGS. 3–5 show different switch wiper contact arrangements.
Figure 6:
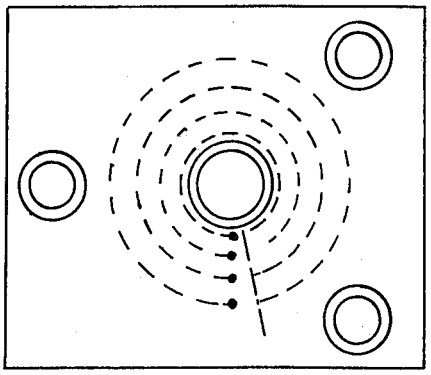
FIGS. 6–8 illustrate, respectively, tracking of the different contact arrangements shown in FIGS. 3–5.
Figure 4:
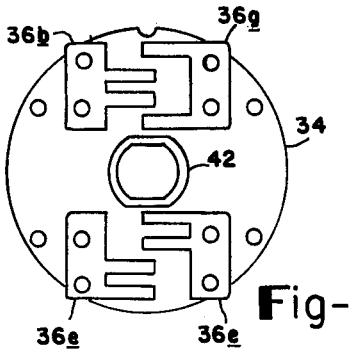
Figure 7:
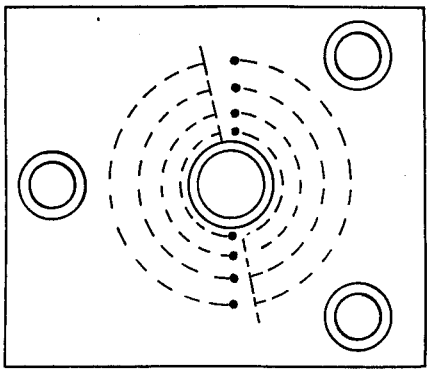
Figure 5:
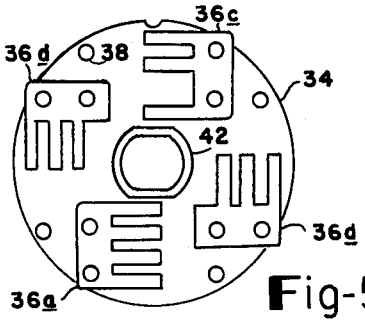
Figure 8:
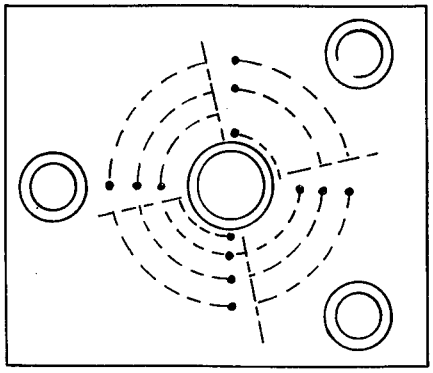

A significant feature of the invention is the flexibility provided by the mounting arrangement of the wipers 36 on the rotor bodies 34. As mentioned earlier, a wiper may be secured to a body in two different operational orientations, one with the fingers of the wiper pointing in a clockwise direction as viewed in FIGS. 2–5, and another with the fingers pointing in a counterclockwise direction. In FIG. 3, for example, the two wipers are mounted in different operational orientations with their fingers interlaced. In FIG. 5, all four wipers are mounted in the same operational orientation, all of the fingers pointing counterclockwise. As will be apparent, this, together with the many different possible wiper configurations, enables a large number of different switching patterns to be provided using only two basic parts—rotor bodies 34 and multifinger wipers 36. The tracking patterns produced by the wiper arrangements depicted in FIGS. 3–5 are shown in FIGS. 6–8, respectively, with solid dots indicating "home" positions for the wiper contacts and curved dashed lines indicating their tracks. Rotation limits are indicated by radially-extending dashed lines.

There is thus provided an improved multiposition rotary switch construction which amply fulfills the various objectives set forth above. And while two preferred embodiments of the invention have been described, and certain modifications suggested, it will be appreciated that various other modifications and changes may be made without departing from the spirit of the invention.

What is claimed is:

1. In a multiposition rotary electrical switch having a stator comprising an insulating substrate bearing a plurality of electrical contact pads arranged in multiple concentric rings on a surface thereof, a rotor comprising a disklike insulating body mounting electrical contact means for simultaneously engaging selected pads in different ones of said rings to interconnect the selected pads, said contact means comprising a multifinger wiper, and means including a shaft supporting said rotor in faceopposed relation to said substrate for rotation relative thereto upon axial rotation of said shaft, the improvement wherein said insulating body includes means on a face thereof for mounting said wiper in either of two different operational orientations, the fingers of said wiper extending in one rotational direction when mounted in one of said orientations and in the opposite rotational direction when mounted in the other of said orientations, and said wiper is mounted in a selected one of said orientations.

2. The improved switch of claim 1, wherein said mounting means comprises a group of spaced-apart mounting studs, which group consists of three generally cylindrical projections disposed at locations on said rotor face corresponding to the corners of an isosceles right triangle, and wherein said wiper when mounted in one of the orientations is anchored on one pair of said projections, and when mounted in another of the orientations is anchored on a different pair.

3. The improved switch of claim 2, wherein said contact means comprises a plurality of multifinger wipers, and wherein said mounting means comprises a like plurality of groups of mounting studs, said groups being disposed at angularly spaced-apart locations on said face of said rotor body, with one wiper mounted at one location on said face in one operational orientation and another wiper mounted at another location on said face in a different operational orientation.

4. In a plural section multiposition rotary electrical switch having at least a pair of stators, each comprising an insulating substrate bearing a set of electrical contact pads arranged in multiple concentric rings on a surface thereof, at least a pair of rotors including one operatively associated with each stator, each rotor comprising a disklike insulating body mounting electrical contact means for simultaneously engaging selected pads in different rings of the associated stator's pad set to interconnect the selected pads, said contact means comprising a multifinger wiper, and means including shaft means supporting said rotors in face-opposed relation to the pad-bearing surfaces of their associated stators for rotation relative thereto upon axial rotation of said shaft means, the improvement wherein each rotor's insulating body includes means on a face thereof for mounting said wiper thereon in either of two different operational orientations, the fingers of said wiper extending in one rotational direction when mounted in one of said orientations and in the opposite rotational direction when mounted in the other of said orientations, and a multifinger wiper is mounted in a selected operational orientation on each of said rotors.

5. The improved switch of claim 4, wherein the contact means of at least one rotor comprises a pair of multifinger wipers, each mounted at a different, angularly spaced-apart location on a face of the rotor and each in a different operational orientation.

6. The improved switch of claim 4, wherein said shaft includes a pair of axially aligned shaft sections, each supporting at least one rotor, and said switch further includes selective rotation enabling means comprising means releasably coupling said shaft sections upon axial movement of one section relative to the other, said selective rotation enabling means comprising a first coupling element connected to one shaft section and including a cylindrical portion disposed in axial alignment with said section, said portion having a longitudinally extending keyway therein, and a second coupling element operatively connected to the other shaft section and including a cylindrical chamber receiving said cylindrical portion of the first element, said second element additionally including a key resiliently engaging said keyway to lock said first and second elements together for rotation as a unit, said keyway being configured to disengage said key therefrom and permit independent rotation of said elements upon axial movement of said first element in a certain direction relative to said second element.

7. In a multiposition rotary electrical switch having a pair of stators, a pair of rotors, each rotor of said pair being operatively associated with a different stator, and means including shaft means supporting said rotors for rotation relative to their associated stators, said shaft means including a pair of axially aligned shaft sections, each supporting a different rotor, means intermediate said rotors enabling selective rotation of either rotor independent of the other, comprising means releasably coupling said shaft sections together for conjoint rotation and means for decoupling said shaft sections upon axial movement of one shaft section relative to the other.

8. The switch of claim 7, wherein said selective rotation enabling means comprises a first coupling element connected to one shaft section and including a cylindrical portion disposed in axial alignment with said section, said portion having a longitudinally extending keyway therein, and a second coupling element operatively connected to the other shaft section and including means defining a cavity receiving said cylindrical portion of the first element, said second element additionally including a key resiliently engaging said keyway to lock said elements together for rotation as a unit, said keyway being configured to disengage said key to permit independent rotation of said elements upon axial movement of said first element in a certain direction relative to said second element.

9. The switch of claim 8, wherein said selective rotation enabling means additionally comprises means for preventing disengagement of said key at selected rotational positions of said switch.

10. The switch of claim 8, wherein said selective rotation enabling means additionally comprises misrotation prevention means for limiting the range of independent rotation of one element relative to the other upon disengagement of said key.

* * * * *